US007426999B2

(12) United States Patent
Leendersten et al.

(10) Patent No.: US 7,426,999 B2
(45) Date of Patent: Sep. 23, 2008

(54) BOTTLE CLOSURE

(76) Inventors: Howard V. Leendersten, P.O. Box 6658, Ketchum, ID (US) 83340; Allen C. Shoup, The Highlands, Seattle, WA (US) 98177

( * ) Notice: Subject to any disclaimer, the term of this patent is extended or adjusted under 35 U.S.C. 154(b) by 72 days.

(21) Appl. No.: 10/685,147

(22) Filed: Oct. 14, 2003

(65) Prior Publication Data

US 2004/0169001 A1 Sep. 2, 2004

Related U.S. Application Data

(60) Provisional application No. 60/418,993, filed on Oct. 15, 2002.

(51) Int. Cl.
*B65D 39/00* (2006.01)

(52) U.S. Cl. ..... 215/355; 215/364

(58) Field of Classification Search ..... 215/358, 215/359–362, 234, 294–299, 364, 356; 220/236–238, 220/787, 789; 222/552, 554, 563
See application file for complete search history.

(56) References Cited

U.S. PATENT DOCUMENTS

| | | | | |
|---|---|---|---|---|
| 34,227 | A * | 1/1862 | Ames | 215/364 |
| 1,204,712 | A * | 11/1916 | Spelling | 215/299 |
| 2,940,629 | A * | 6/1960 | Cros | 215/359 |
| 3,245,569 | A * | 4/1966 | Essich | 215/329 |
| 3,937,350 | A * | 2/1976 | Volker | 215/361 |
| 4,889,251 | A | 12/1989 | Hojnoski | |
| 5,109,997 | A * | 5/1992 | Phillips | 215/360 |
| 5,722,548 | A * | 3/1998 | Hojnoski | 215/299 |
| 5,975,322 | A | 11/1999 | Reid | |
| 6,029,836 | A | 2/2000 | Ligeras | |
| 6,250,337 | B1 * | 6/2001 | Bevacco | 138/89 |
| 6,536,618 | B1 * | 3/2003 | Hwang et al. | 215/358 |
| 6,719,160 | B2 * | 4/2004 | Sen-Yih | 215/361 |

FOREIGN PATENT DOCUMENTS

| | | | | |
|---|---|---|---|---|
| WO | WO 02/83515 A1 * | 4/2001 | | 215/358 |

* cited by examiner

*Primary Examiner*—Lien M. Ngo
(74) *Attorney, Agent, or Firm*—McDonnell Boehnen Hulbert & Berghoff LLP

(57) ABSTRACT

A bottle closure including a shell having an open first end, a closed second end, an inner wall and an outer wall, the combination forming conical space and a tapered core having a first end, a second end and conical surface positioned between the first end and second end wherein the tapered is located in the shell conical space.

10 Claims, 1 Drawing Sheet

BOTTLE CLOSURE

This application claims the benefit of the filing date of U.S. provisional patent application No. 60/418,993, filed on Oct. 15, 2002.

BACKGROUND OF THE INVENTION (1) Field of the Invention

This invention concerns a bottle closure device useful for sealing thin necked bottles such a wine bottles.

(2) Description of the Art

For centuries, corks have been used as a bottle closure. Even today, wines of medium to high quality are packaged in bottles that are sealed with corks. Cork is typically grown in Portugal and comes in a variety of grades. High quality cork can be expensive. Further, a small percentage of wines becomes tainted or "corked" by cork taste as a result of imperfect corks. Likewise, a small percentage of bottled wines go bad due to imperfections in the cork seal that allow the bottled wine to become contaminated. Further, cork can deteriorate over time. Indeed, some vintners must periodically re-cork wine aging in bottles as a result of cork decomposition. The use of cork as a wine bottle seal can be costly for these reasons.

Cork is also not user friendly. A cork requires a tool to removed it from the bottle. Often the process of removing the cork from the bottle leaves pieces of cork in the wine that must be fished out when the wine in poured in a glass. Further, corked bottles are not easily resealed resulting in bottle leakage or contamination of the wine remaining in the resealed bottle.

The is a need therefore for a bottle closure devices that are inexpensive, that do not degrade, that maintain a seal for a long period of time, and that are easy to disengage from a bottle opening and reinsert into the opened bottle.

SUMMARY OF THE INVENTION

One aspect of this invention is a bottle closure comprising a shell having an open first end, a closed second end, an inner wall and an outer wall, the combination forming conical space and a tapered core having a first end, a second end and conical surface positioned between the first end and second end wherein the tapered core is larger than the shell conical space.

Another aspect of this invention is method for sealing a bottle with a bottle closure comprising the steps of: locating a shell having an open first end, a closed second end, an inner wall and an outer wall, the combination forming conical space, into the opening of a bottle; and directing a tapered core having a first end, a second end and conical surface positioned between the first end and second end wherein the tapered core is larger than the shell conical space into the shell open first end and into the shell conical space and forcing the shell outer wall against the bottle opening to form a sealed bottle opening.

Still another aspect of this invention is a method for removing a bottle closure of this invention from a sealed bottle by the further steps of grasping the handle of a pulling tool and placing an end of a tool that has a shape complementary to the core shaped aperture into the core shaped aperture; and pulling the bottle closure from the bottle opening with the pulling tool.

DESCRIPTION OF THE CURRENT EMBODIMENT

The present invention relates to a bottle closure system that replaces a traditional cork for in sealing bottles such as wine bottles.

Figure 1:
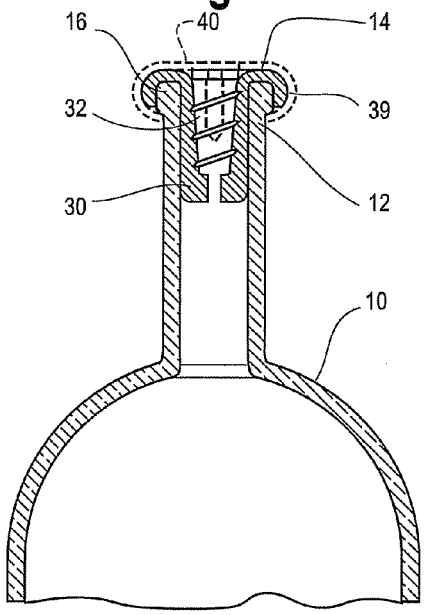
FIG. 1 is a bottle including an embodiment of a bottle closure of this invention.

A preferred embodiment of a bottle closure of this invention is depicted in FIGS. 1-3. FIG. 1 depicts a fully assembled bottle closure of this invention after it has been used to seal bottle 10. The bottle closure of this invention will typically be associated with narrow necked seal bottles such as the bottle 10 depicted in FIG. 1. Bottle 10 includes a neck 12 and an opening 14. A bottle closure is located in opening 14 and includes core 20 and shell 30. The bottle closure further includes a flange 39 associated with the shell 30 that at least partially covers rim 16 of bottle 10. Bottle 10 further includes an optional cap 40 that covers opening 14 of bottle 10.

Figure 2A:
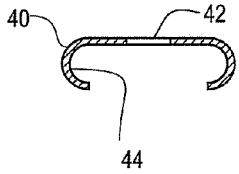
FIGS. 2A-2B are side and top views of a cap that may optionally be associated with a bottle closure of this invention.
Figure 2B:
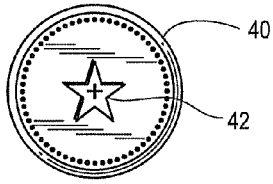

FIGS. 2A and 2B are side and top views of optional cap 40. Cap 40 preferably is of a sufficient size to cover rim 16 of bottle 10. A preferred cap 40 includes a curved perimeter 44 that encompasses rim 16 and a central opening 42. Central opening 42 will preferably have a geometric shape that is complementary to the shape of optional aperture 28 in core 20. Cap 40 may be made of any material that is used for sealing bottle closures. Preferably cap 40 is manufactured of a moldable material such as lead, tin, aluminum, or plastic.

Figure 3A:
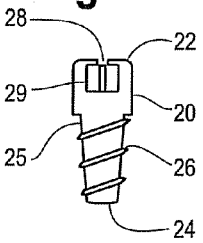
FIG. 3A is a side view of an embodiment of a core useful in a bottle closure of this invention.

FIGS. 3A-3D are side views of core 20 and shell 30 of a preferred closure device of this invention before, during and after formation of a closure. FIG. 3A shows a preferred core 20 that is useful in a bottle closure of this invention. Core 20 includes a first end 22 and a second end 24. Core 20 further includes a conical surface 25 located between first end 22 and second end 24. It is preferred that conical surface 25 is inwardly tapered towards second send 24. Core 20 may optionally include a shaped aperture 28. If core 20 includes an optional shaped aperture 28, then the aperture will have a shape that is complimentary to the key 56 of opening tool 50.

Figure 3B:
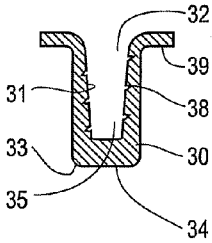
FIG. 3B is a side view of an embodiment of a shell useful in a bottle closure of this invention.

FIG. 3B is a side view of a shell 30 useful in a bottle closure of this invention. Shell 30 includes an open first end 32, a second end 34, a wall inner face 31 and a wall outer face 33, the combination of which forms conical space 35. It is preferred that conical space 35 tapers inwardly from open first end 32 towards second end 34. Shell 30 further includes an optional flange 39 associated with open first end 32. Shell 30 may also include optional threads 38 associated with wall inner face 31.

In order to form a tight seal on a bottle, shell 30 should be made of a malleable material that is capable of forming a seal when the material is forced against the neck 12 of bottle 10. Any malleable materials that are used in bottle closures may be used to manufacture shell 30. Examples of useful materials include rubber and malleable plastic materials such as styrene butadiene rubber, malleable urethane and so forth. Core 20 may be manufactured out of materials that are the same as or different from the materials used to manufacture shell 30. It is preferred that core 20 is manufacture from a rigid material such as rigid plastic or metal. That way, core 20 will be sturdy enough to force the walls of shell 30 against neck 12 of bottle 10 in order to form a tight closure.

Figure 3C:
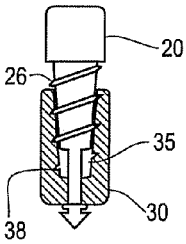
FIG. 3C is a side view of a core and a shell of a bottle closure of this invention as the core is being associated with the shell.
Figure 3D:
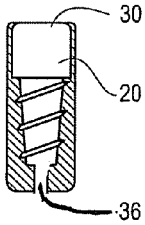
FIG. 3D is a side view of a fully assembled bottle closure of this invention.

FIGS. 3C and 3D depict core 20 and shell 30 of the bottle closure of this invention as core 20 is being associated with shell 30 and, in the case of FIG. 3D, after the bottle closure is formed. Core 20 is associated with shell 30 in FIG. 3C by placing second end 24 of core 20 into conical space 35 of shell 30 and directing core second end 20 into conical space 35 until core 20 cannot be indexed any further into conical space 35. Core 20 may be directed into shell 30 by any method that is known for creating a seal such as by pushing core 20 into shell 30 or by rotating core 20 as it is being urged into shell 30. In a preferred embodiment, core 20 includes threads 26 that are complimentary to threads 38 associated with wall inner face 31 of shell 30 and core 20 is threaded into shell 30. Regardless how core 20 is associated with shell 30, the action of urging core 20 into shell 30 causes the walls outside face 33 of core 30 to be urged tightly against neck 12 of bottle 10 thereby sealing the bottle. Shell 30 may include an optional aperture 36 associated with shell second end 34. The aperture allows air to escape from conical space 35 into the bottle as core 28 is associated with shell 30.

Core 20 and shell 30 may be irreversibly or reversibly associated with one another. For example, an adhesive material can be placed on core 20 and/or in shell 30 to cause core 20 to be welded to shell 30 once the closure is formed.

As mentioned above, shell 30 may include flange 39 associated with shell first end 32. Flange 39 may serve any one of a number of functions. Flange 39 may be used to position shell 30 in a bottle opening. Flange 39 also may form a seal around rim 16 of bottle 10. Furthermore, flange 39 may, alone or in conjunction with cap 40 protect rim 16 of a glass bottle from cracking or chipping.

Figure 4:
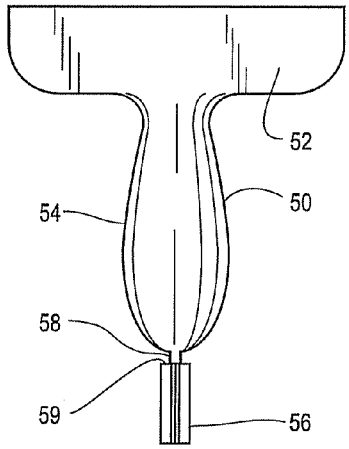
FIG. 4 is a side view of a tool useful for removing a bottle closure of this invention from a bottle.

The bottle closure of this invention may be removed from a sealed bottle by any means known for removing a bottle seal from a bottle. For example, if core 20 is made from a soft but rigid material then a corkscrew for conventional wine bottle opening device may be used to remove the closure of this invention from a bottle. In a preferred embodiment, a tool 50 shown in FIG. 4 will be used to remove the bottle closure of this invention from the bottle. Tool 50 includes a handle 52, a stem 54, a key 56 and an interruption 58 between key 56 and stem 54. Key 56 is used to open a closure device of this invention by placing key 56, which has a specific geometric shape such as a triangle, star, octagon, pentagon and so forth, into complimentary shaped aperture 28 of core 20. Grasping handle 52 of tool 50 by ones hand, tool 50 is slightly rotated and pulled away from the bottle closure until shoulder 59 of tool 50 engages rim 29 of shaped aperture 28 thereby preventing tool 50 from being removed from aperture 28. Once key 56 of tool 50 is locked into aperture 28, a person can grasp handle 52 and pull the bottle closure in order to remove it from neck 12 of bottle 10.

What is claimed is:

1. A bottle closure comprising;

a shell having an open first end, a second end including an aperture, an inner wall and an outer wall, the combination forming conical space; and a tapered core having a first end, a second end and conical surface positioned between the first end and second end wherein the tapered core is larger than the shell conical space and wherein the core first end includes a shaped aperture that includes a key way for grasping a pulling tool.

2. The bottle closure of claim 1 wherein the core conical surface includes threads and the shell inner wall includes threads that are complementary to the core threads.

3. The bottle closure of claim 2 wherein the core includes threads selected from male threads or female threads.

4. The bottle closure of claim 1 wherein the core conical surface is irreversibly associated with the shell inner wall.

5. The bottle closure of claim 1 including a cap having a central opening that is complementary to the core shaped aperture.

6. A method for sealing a bottle with a bottle closure comprising the steps of:

(a) locating a shell having an open first end, a second end including an aperture, an inner wall and an outer wall, the combination forming conical space, into the opening of a bottle the shell further including a flange that has a width that is greater than the width of the bottle opening and wherein the shell is directed into the bottle opening until the flange touches the bottle opening;

(b) directing a tapered core having a first end, a second end and conical surface positioned between the first end and second end wherein the tapered core first end includes an shaped aperture having a key way for grasping a pulling tool wherein the tapered core is larger than the shell conical space into the shell open first end and into the shell conical space and forcing the shell outer wall against the bottle opening to form a sealed bottle opening; and removing the bottle closure from the bottle opening by the further steps of:

i. grasping the handle of a pulling tool and placing an end of a pulling tool that has a shape complementary to the core shaped aperture into the core shaped aperture; and ii. pulling the bottle closure out of the bottle opening with the pulling tool.

7. The method of claim 6 wherein the core conical surface includes threads and the shell inner wall includes threads that are complementary to the core threads and the tapered core is directed into the shell conical space by threading the core into the shell.

8. The method of claim 6 wherein the core includes threads selected from male threads or female threads.

9. The method of claim 6 wherein the core circumferential surface is irreversibly associated with the shell inner wall when the bottle is sealed.

10. The method of claim 6 wherein a cap having a central opening that is complementary to the core shaped aperture is applied to cover the bottle opening when the bottle closure is formed.

* * * * *

UNITED STATES PATENT AND TRADEMARK OFFICE

CERTIFICATE OF CORRECTION

PATENT NO. : 7,426,999 B2
APPLICATION NO. : 10/685147
DATED : September 23, 2008
INVENTOR(S) : Shoup et al.

It is certified that error appears in the above-identified patent and that said Letters Patent is hereby corrected as shown below:

On the title page item 76, Inventors: change the order of the inventors from Howard V. Leendersten and Allen C. Shoup to Allen C. Shoup and Howard V. Leendersten Signed and Sealed this Eighteenth Day of November, 2008

JON W. DUDAS
*Director of the United States Patent and Trademark Office*